US005603453A

United States Patent [19]

Weaver et al.

[11] Patent Number: 5,603,453

[45] Date of Patent: Feb. 18, 1997

[54] DUAL FLUID SPRAY NOZZLE

[75] Inventors: Edwin H. Weaver, Lafayette, N.J.; Jean-Francois Vicard, Lyon, France

[73] Assignee: LAB S.A., Lyon, France

[21] Appl. No.: 366,600

[22] Filed: Dec. 30, 1994

[51] Int. Cl.[6] ..... B05B 7/04

[52] U.S. Cl. ..... 239/8; 239/427; 239/432; 239/591; 239/419.3

[58] Field of Search ..... 239/419, 419.3, 239/427, 432, 433, 591, 590, 590.3, 567, 8, 9; 261/115, 116, 118, 78.2, DIG. 9

[56] References Cited

U.S. PATENT DOCUMENTS

| | | | |
|---|---|---|---|
| 2,012,139 | 8/1935 | Peabody . | |
| 2,933,259 | 4/1960 | Raskin . | |
| 3,110,444 | 11/1963 | Eakins . | |
| 3,618,863 | 11/1971 | Hughes . | |
| 3,784,111 | 1/1974 | Piggott . | |
| 3,787,169 | 1/1974 | Gjerde | 239/432 X |
| 3,867,092 | 2/1975 | Sage et al. | 239/432 X |
| 4,101,073 | 7/1978 | Curran . | |
| 4,349,156 | 9/1982 | Haruch et al. . | |
| 4,456,181 | 6/1984 | Burnham . | |
| 4,591,099 | 5/1986 | Emory et al. | 239/419 |
| 4,815,665 | 3/1989 | Haruch . | |
| 4,821,964 | 4/1939 | Mezger et al. . | |
| 4,828,182 | 5/1989 | Haruch . | |
| 4,899,937 | 2/1990 | Haruch . | |
| 4,989,788 | 2/1991 | Bendig et al. . | |
| 5,176,325 | 1/1993 | Vidusek . | |
| 5,240,183 | 8/1993 | Bedaw et al. . | |
| 5,372,312 | 12/1994 | Vidusele | 239/419.3 |

FOREIGN PATENT DOCUMENTS

| | | | |
|---|---|---|---|
| 92/04127 | 3/1992 | European Pat. Off. | 239/419 |

*Primary Examiner*—Kevin Weldon
*Attorney, Agent, or Firm*—Dowell & Dowell

[57] ABSTRACT

A dual fluid spray nozzle adapted to produce a finely atomized spray of a liquid includes a body which encloses a first atomization chamber, a nozzle tip, and a plate disposed between the first atomization chamber and the nozzle tip so as define a second atomization chamber. The plate defines a plurality of passages through which liquid passes from the first atomization chamber into the second atomization chamber and is further atomized. The nozzle may include a plurality of plates and more than two atomization chambers. In such embodiments, each plate has a reduced total cross-sectional area of passages relative to the preceding plate.

31 Claims, 3 Drawing Sheets

DUAL FLUID SPRAY NOZZLE

BACKGROUND OF THE INVENTION

1. Field of the Invention

The invention is directed to the field of spray nozzles and, more particularly, to a dual fluid spray nozzle adapted to produce a finely atomized spray of liquids.

2. Description of the Related Art

In many liquid spraying applications, it is desirable to produce finely atomized droplets of a liquid reagent. For example, in semi-dry scrubbing systems used to remove harmful gases such as acid flue gases produced by the burning of coal or of wastes, small droplets of a controlled size distribution optimize the mixing of the reagent and the flue gases and maximize performance of the gas cleaning process. Small droplets also evaporate more readily and minimize the dimensions of the reactor chamber in which the liquid is sprayed, while the accumulation of corrosive substances on the reactor walls is avoided.

The known dual fluid spray nozzles are generally unable, however, to produce finely atomized droplets of liquids without experiencing a number of technical problems. In a nozzle, the diameter and the corresponding cross-sectional flow area of the fluid passages affect the size distribution of the atomized droplets. The finer are the flow passages, generally the finer are the sprayed droplets. Accordingly, the diameter of the passages has been reduced in the known dual fluid spray nozzles in an effort to decrease the average size of the atomized droplets and produce a finely atomized spray.

This approach to producing a finely atomized spray has been inadequate for several reasons. For the atomization of slurries, reducing the diameter of the fluid passages causes a corresponding increase in the rate of clogging of the passages by the slurry particles. The reduced diameter passages effectively filter the particles and limit the maximum size of particles which can physically pass through them. Clogging is a fundamental problem associated with the atomization of slurry materials, even though, for most liquids, suspended solids are always present and may occasionally cause clogging.

Accordingly, selecting the size of the flow passages in a spray nozzle involves a balancing of the acceptable droplet size distribution against the acceptable rate of clogging of the nozzle. For slurries, clogging is so severe that it is not possible to achieve the desired droplet size distribution using the known dual spray nozzles as the necessary flow passage diameter is too small to be functional.

In addition to their clogging characteristics, slurry materials are also erosive and corrosive to the conventional materials used to construct spray nozzles.

In order to reduce the clogging of nozzle passages during slurry spraying operations, it is theoretically possible to increase the velocity of the atomizing fluid and the entrained slurry particles. Although this solution theoretically reduces clogging, at least when the slurry particles are smaller than the diameter of the passages, it is inadequate because increasing the velocity simultaneously increases the erosion rate of the passages. Therefore, the practical upper limit of the operating velocity is based on the acceptable level of wear of the nozzle. If erosion is too severe at the velocity necessary to prevent clogging, then such velocity is economically infeasible due to the shortened service life of the nozzle and the corresponding increased replacement costs.

Furthermore, the atomization of slurries using dual fluid spray nozzles is energy intensive, and increasing the velocity of the atomizing fluid only further increases energy usage as it increases the amount of energy required to input the atomizing fluid and slurry into the nozzle.

Therefore, in view of the inadequacies of the known dual fluid spray nozzles, there has been a need for a dual fluid spray nozzle which is capable of producing a finely atomized spray of a slurry at a reduced energy demand, and of producing a finely atomized spray at a reduced rate of erosion of the nozzle.

SUMMARY OF THE INVENTION

The present invention has been made in view of the above-described inadequacies of the known spray nozzles and has as an object to provide a dual fluid spray nozzle which is capable of producing a finely atomized spray of a slurry at a reduced energy demand.

Another object of the invention is to provide a dual fluid spray nozzle which is capable of producing a finely atomized spray of a slurry at a reduced rate of erosion of the nozzle.

Additional objects and advantages of the present invention will become apparent from the detailed description and drawing figures which follow, or by practice of the invention.

To achieve the objects of the invention, the dual fluid spray nozzle in accordance with a preferred embodiment of the invention comprises a body which defines a first atomization chamber, a first inlet in the body through which an atomizing fluid is introduced into the first atomization chamber, and a second inlet in the outer wall through which a liquid to be atomized is introduced into the first atomization chamber.

An initial atomization means is disposed in the first atomization chamber to initially atomize the liquid introduced into the first atomization chamber via the second inlet.

A nozzle tip is mounted to the body. The nozzle tip defines a plurality of discharge openings through which an atomized spray is discharged.

The dual fluid spray nozzle further comprises a plate which forms a front wall of the first atomization chamber. The plate and the nozzle tip define a second atomization chamber disposed downstream relative to the first atomization chamber. The plate defines a plurality of passages through which the initially atomized liquid passes from the first atomization chamber into the second atomization chamber and is further atomized.

In accordance with another preferred embodiment of the invention, the dual fluid spray nozzle may comprise a plurality of plates, forming additional atomization chambers, disposed along the length of the nozzle. Each plate preferably has a reduced total cross-sectional area of passages relative to the preceding plate, so that the velocity of the atomizing fluid and the liquid increase through each successive plate.

DETAILED DESCRIPTION OF THE PREFERRED EMBODIMENT

Figure 1:
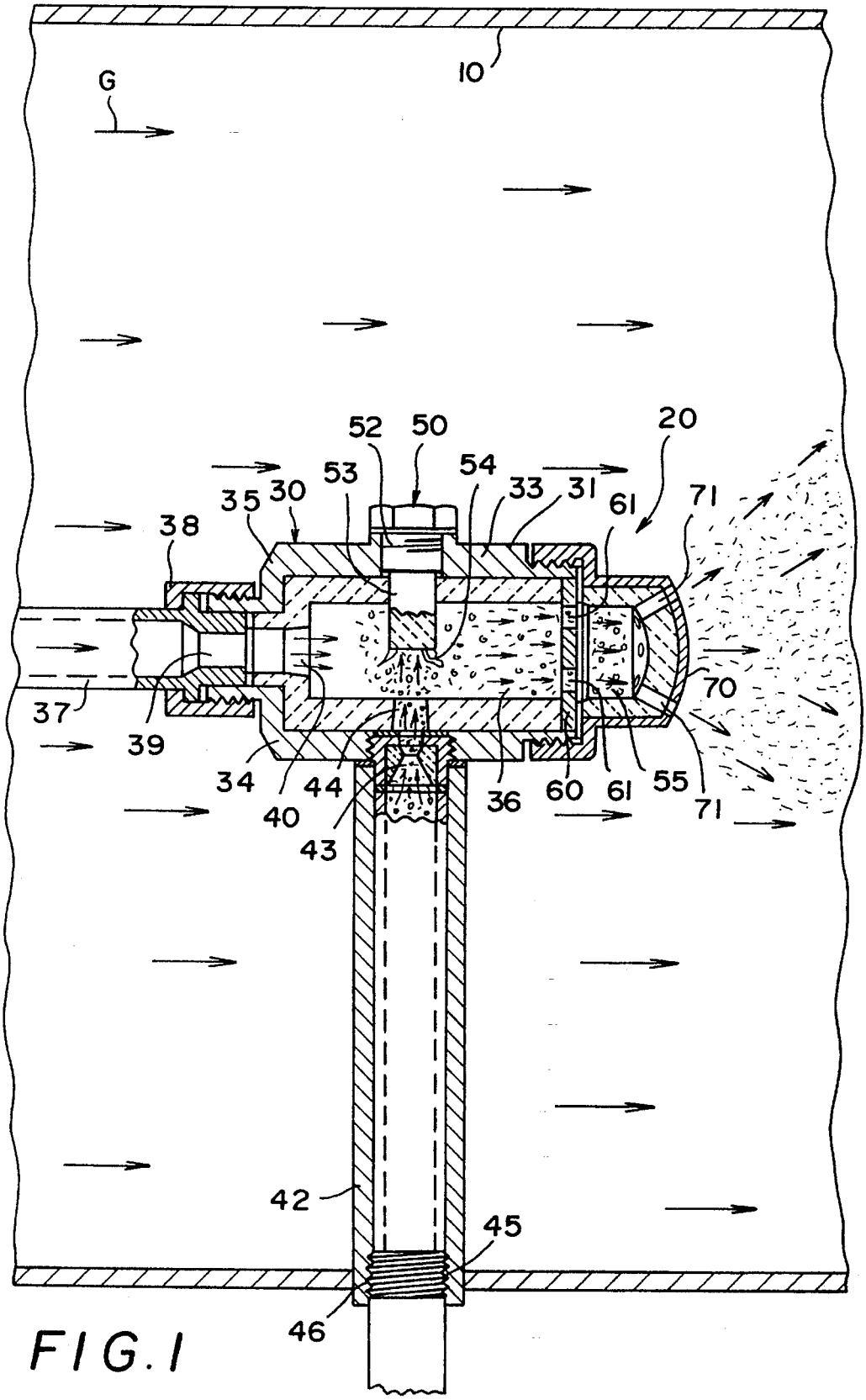
FIG. 1 is a cross-sectional illustrational view of a dual fluid spray nozzle in accordance with a preferred embodiment of the invention the environment of a gas conduit.

With reference to the drawing figures, FIG. 1 illustrates a dual fluid spray nozzle 20 in accordance with a preferred embodiment of the invention. The spray nozzle utilizes an atomizing fluid to produce an atomized spray of a liquid.

The spray nozzle 20 is illustrated disposed in a conduit 10 which contains a stream of gases "G". The nozzle is particularly adapted to produce a finely atomized spray of a selected slurry composition, such as a lime milk slurry comprised of lime and water. Lime milk is conventionally used as a cleaning medium in semi-dry gas cleaning systems. The illustrated stream of gases may be flue gases produced by the burning of coal in power plants or of waste in incineration plants. As shown, the nozzle produces a spray "S" of an atomized liquid which interacts with the flue gases to remove undesired and harmful components such as sulfur dioxide, hydrochloric acid and fluoridic acid.

In accordance with the invention, the spray nozzle 20 comprises a body 30. The body is preferably cylindrical shaped and it comprises an outer housing 31 composed of a metallic material. The outer housing 31 is comprised of a pair of opposed side walls 33, 34, and a rear wall 35, which define a first atomization chamber 36. A liner 32 composed of an erosion and corrosion resistant ceramic material or the like lines the outer housing 31.

An atomizing fluid supply line 37 is connected to the rear wall 35 at the upstream end of the nozzle. A connector 38 secures the atomizing fluid supply line 37 to the nozzle body. The atomizing fluid supply line has a reduced diameter portion 39 in communication with an orifice 40 formed in the liner 32. The orifice 40 directly communicates with the first atomization chamber 36.

The atomizing fluid is preferably pressurized air. Other fluids such as steam and the like may optionally be utilized in the nozzle.

A liquid supply line 41 is secured to the side wall 34 of the body by a connector 42. As shown, the connector 42 includes a reduced diameter portion 43 in communication with an orifice 44 formed in the liner 32. The orifice 44 communicates directly with the first atomization chamber 36. The connector 42 includes interior threads 45 to engage mating threads 46 formed on the liquid supply line 41.

In accordance with the invention, the nozzle 20 comprises initial atomization means to initially atomize the liquid after it is introduced into the first atomization chamber 36 via the liquid supply line 41. The initial atomization means is preferably a target bolt 50 which is adjustably secured to the side wall 33 of the body, opposite to the orifice 44. The target bolt includes a base 51 having exterior threads 52 to engage mating threads (not shown) formed on the wall of an opening, through which the target bolt extends, provided in the side wall 33. A post 53 extends into the first atomization chamber and includes a surface 54 which is aligned with the orifice 44. Liquid introduced into the first atomization chamber through the orifice 44 immediately impinges upon the surface 54, and is broken-up into filaments and large droplets.

The target bolt 50 is preferably composed of a wear resistant material such as a ceramic and the like.

The resulting filaments and large droplets are further broken-up by the atomizing fluid stream introduced into the first atomization chamber 36 through the orifice 40. As the atomizing fluid moves past the surface 54, it shears the slurry into smaller particles. The atomizing fluid mixes with the sheared particles and transports them through the first atomization chamber.

The first atomization chamber 36 is further defined by a front wall formed by a plate 60. A second atomization chamber is defined between the plate 60 and a nozzle tip 70 disposed at the discharge end of the nozzle.

Figure 3:
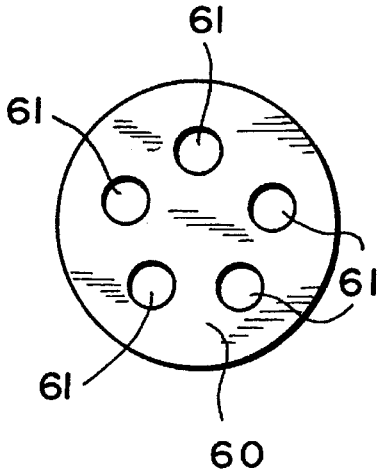
FIG. 3 is a view of the plate which forms the front wall of the first atomization chamber of the nozzle, depicting the arrangement of the passages in the plate.

In accordance with the invention, the plate 60 defines a plurality of passages 61 through which the slurry particles pass from the first atomization chamber 36 into the second atomization chamber 55. Referring to FIG. 3, the plate preferably defines five passages 61 arranged in a circular pattern. The passages 61 further shear and reduce the size of the slurry particles before entering the second atomization chamber. After passing through the passages 61, additional mixing of the slurry particles and the atomizing fluid occurs in the second atomization chamber.

The passages 61 preferably have a diameter larger than approximately twice the diameter of the largest slurry particles introduced into the first atomization chamber 36 through the orifice 44. By forming the passages of this diameter, the bridging of two or more slurry particles in the passages is substantially prevented.

As a further measure to prevent the clogging of the passages, before the slurry is introduced into the first atomization chamber 36, it is preferably filtered to remove the particles larger than approximately one-half the diameter of the passages 61. Lime milk particles are filtered to a maximum diameter of approximately 1.5 mm, and, accordingly, the diameter of the passages 61 is preferably at least approximately 3 mm.

Figure 8:
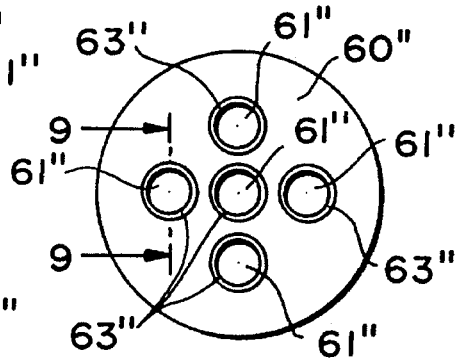
FIG. 8 illustrates an alternative embodiment of the plate shown in FIG. 3.

The plate 60 may have a different number of passages than five, and the passages may also be positioned in different arrangements about the plate. For example, referring to FIG. 8, the plate 60" defines four passages arranged in a circular pattern, and a fifth centrally located passage. The plate 60" is adapted to be used in combination with a nozzle tip, such as the nozzle tip 70' illustrated in FIG. 4, having a centrally located discharge opening 71'.

Forming a plurality of flow passages in the plate 60 separating the atomization chambers 36 and 55 improves the performance of the nozzle 20 in comparison to the known nozzles in which only one passage is formed in the plate. More particularly, at a given velocity of the atomizing fluid and a given energy input to the nozzle, the dual fluid spray nozzle in accordance with the invention produces an atomized spray of a comparatively smaller mean particle size, and a particle size distribution defined by smaller minimum and maximum sized particles. The energy input is determined by the rate of input of the atomizing fluid and liquid into the nozzle, and the respective pressures of the atomizing fluid and liquid. The dual fluid spray nozzle further produces an equivalent mean atomized particle size and approximately the same particle size distribution at a lower velocity of the atomizing fluid, and a corresponding lower rate of erosion and a lower energy demand.

The nozzle tip 70 defines a plurality of discharge openings 71 which finally atomize the liquid before it is discharged into the atmosphere. The discharge openings also control the spray pattern of the atomized slurry such that a substantially cone-shaped spray pattern "S" is produced. To achieve such a pattern, the openings 71 are oriented at an angle of preferably between about 3°–7° relative to the longitudinal axis of the nozzle as illustrated in FIG. 1.

Figure 2:
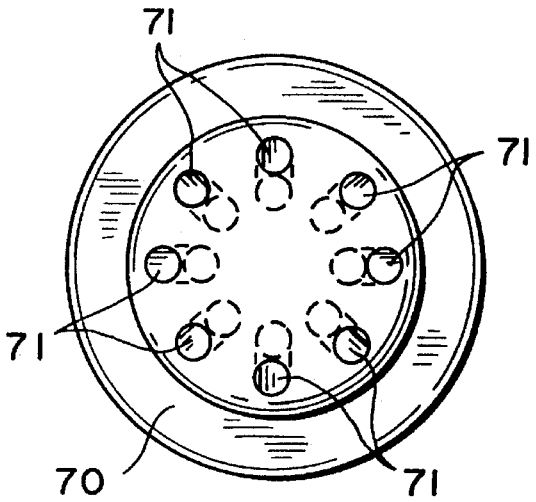
FIG. 2 is a front view of the nozzle of FIG. 1 depicting the arrangement of the discharge openings in the nozzle tip.

As illustrated in FIG. 2, the nozzle tip 70 of the dual fluid spray nozzle 20 defines eight openings 71 positioned in a circular arrangement. The nozzle tip may optionally define a different number of openings and the openings may be positioned in different arrangements to produce different spray patterns.

The nozzle tip 70 is preferably formed of a wear and corrosion resistant material such as a ceramic. The nozzle tip 70 is removable from the remainder of the nozzle to enable the plate(s) to replaced as necessary.

Figure 4:
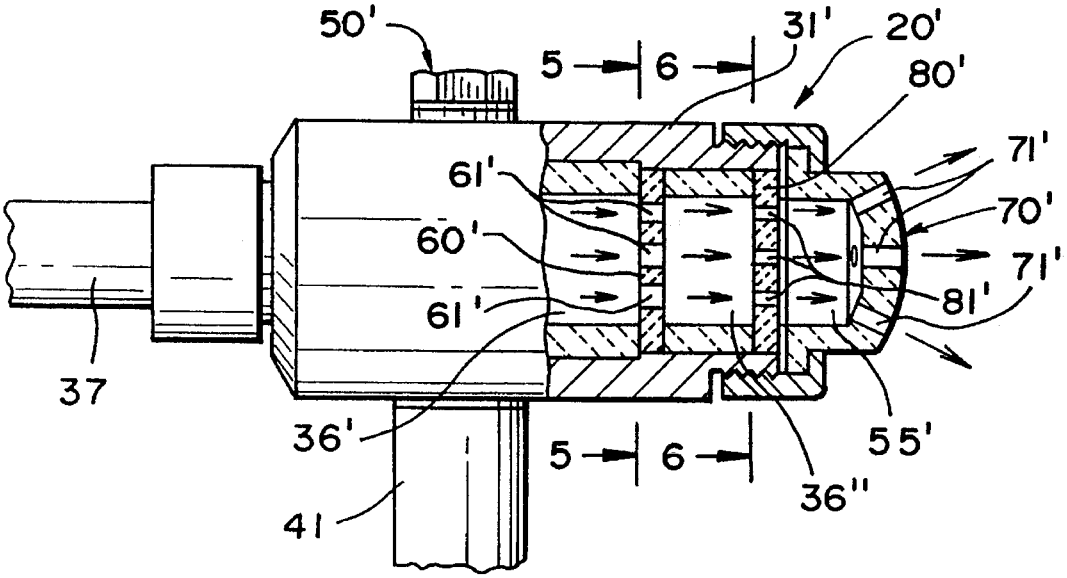
FIG. 4 is a cross-sectional illustrational view of a dual fluid spray nozzle in accordance with another preferred embodiment of the invention.

FIG. 4 illustrates another embodiment 20' of the spray nozzle in accordance with the invention. The nozzle 20' comprises a first plate 60', a second plate 80' and three atomization chambers 36', 36" and 55'. The first plate 60' separates the first atomization chamber 36' and the second atomization chamber 36", and the second plate 80' and the nozzle tip 70' define the third atomization chamber 55'.

The first plate 60' and the second plate 80' each have a plurality of flow passages 61' and 81', respectively. Each of the flow passages in the respective plates are preferably of the same diameter, and the passages 81' are preferably of a smaller diameter than the passages 61'. Accordingly, for a given equal number of passages in the plates 60' and 80', the smaller total cross-sectional area of the passages 81' causes the velocity of the atomizing fluid to be greater passing through them than through the passages 61'. Furthermore, the openings 71' are of a smaller diameter than the passages 81', and the total cross-sectional area of the openings 71' is less than the total cross-sectional area of the passages 81'. Accordingly, the velocity of the atomizing fluid is greater through the openings 71' than through the passages 81'.

A relatively larger total cross-sectional area of the passages 61' may optionally be achieved by forming equally sized passages in each plate 60' and 80', but forming a lesser number of passages 81' in the plate 80'.

In accordance with the invention, the nozzle may optionally comprise more than two plates and, accordingly, more than three atomization chambers. In such embodiments, the total cross-sectional area of the passages formed in each successive plate is decreased in the downstream direction of the nozzle.

Figure 9:
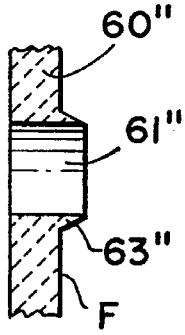
FIG. 9 is a cross-sectional view in the direction of line 9—9 of FIG. 8.

In accordance with the invention, the perimeter of the passages in the plate 60 separating the atomization chambers 36 and 55 may be made sharper to affect atomization. As illustrated in FIG. 9, the passages 61" shown in FIG. 8 extend forwardly of the front face "F" of the plate 60" due to the presence of extended wall portions 63". The sharpness of the passages 61" exceeds the sharpness of the plate 60".

Figure 5:
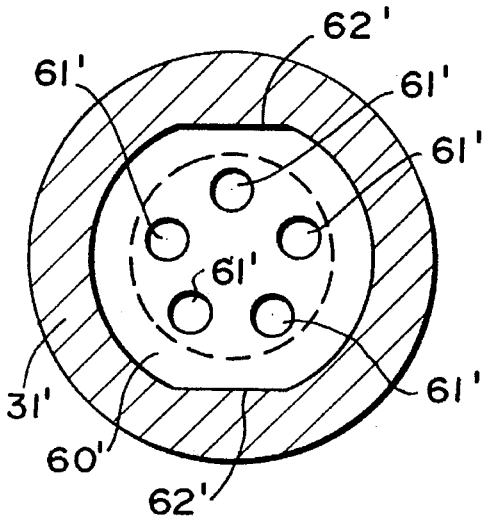
FIG. 5 is a cross-sectional view in the direction of line 5—5 of FIG. 4.
Figure 6:
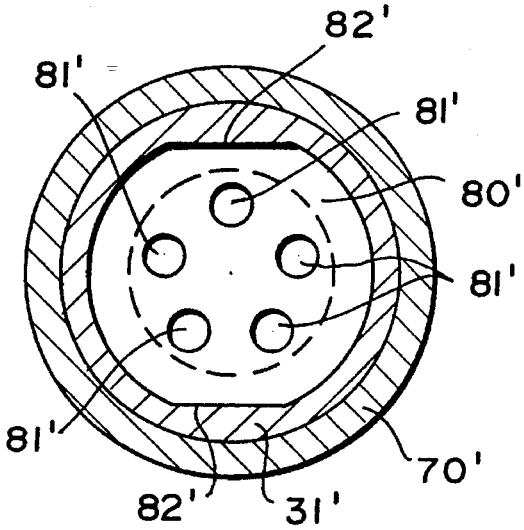
FIG. 6 is a cross-sectional view in the direction of line 6—6 of FIG. 4.

As illustrated in FIG. 5 and 6, the passages 61' and 81' are arranged in the same circular pattern about the plates 60' and 80', respectively. Accordingly, as shown in FIG. 4, the passages 61' and 81' are substantially in alignment with each other when the plates 60' and 80' are used together in the nozzle.

FIG. 4 also illustrates the plates 60' and 80' as having centrally located passages 61' and 81', respectively, which are in alignment with each other, and with a central discharge opening 71' formed in the nozzle tip 70'.

Figure 7:
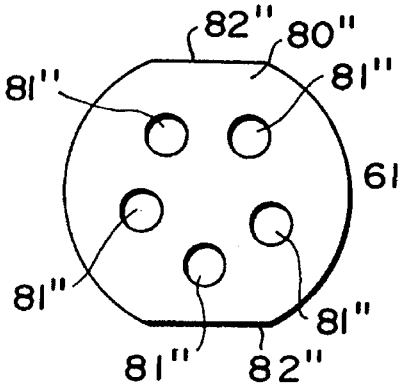
FIG. 7 illustrates an alternative embodiment of the plate shown in Fig. 6.

The passages in adjacent plates may optionally not be aligned with each other. FIG. 7 illustrates a plate 80" which may be used in combination with the plate 60'. As shown, the plate 80" defines a plurality of passages 81" located at different angular positions than the passages 81'. Consequently, when the plate 80" is used with the plate 60', the passages 81" and 61' are not aligned with each other.

In accordance with the invention, the nozzle may comprise means for aligning the passages formed in successive plates. As shown in FIGS. 5–7, the plates 60', 80' and 80" are formed with flat exterior faces 62', 82' and 82", respectively, to ensure that the passages in adjacent plates are located at specific angular positions when the plates are fitted in the nozzle. The flat faces 62' and 82' cause the passages 61' and 81' to be aligned when the plates 60' and 80' are used in combination, and the flat faces 62' and 82" cause the passages 61' and 81" to be out of alignment when the plates 60' and 80" are used together.

The dual-fluid spray nozzle in accordance with the invention is capable of producing a finely atomized spray of different liquids, such that it can be used in a wide range of applications. The spray nozzle is particularly adapted, however, for atomizing slurries. As described above, the known dual fluid spray nozzles are generally unable to produce a finely atomized spray of slurries due to excessive clogging, erosion and energy usage.

To demonstrate a number of advantages of the present invention, a series of five atomization tests, A–E, were performed. The following description of the tests should not be construed as limiting the scope of the invention in any manner.

In the tests, a dual fluid spray nozzle as illustrated in FIGS. 1–3 was employed. The nozzle was comprised of two atomization chambers and a plate dividing the chambers. Water was used as the liquid and pressurized air as the atomizing fluid.

In tests A, C and D, the plate defined a single, centrally located fluid passage having a diameter of 12.7 mm (0.5 in) and a cross-sectional area of 127 $mm^2$ (0.2 $in^2$).

In tests B and E, the plate was formed with five fluid passages to demonstrate the advantages of providing a plurality of flow passages in the plate. The five passages each had a diameter of 5.6 mm (7/32 in), giving a total cross-sectional area of 123 $mm^2$ (0.19 $in^2$). The five passages were equally spaced in a circular pattern about the plate such as shown in FIG. 3.

For each of the tests A–E, the nozzle tip had the same construction and defined eight equally spaced discharge openings arranged in a circular pattern such as shown in FIG. 2. Each of the eight openings had a diameter of 3.6 mm (9/64 in), representing a total cross-sectional area of 81 $mm^2$ (0.12 $in^2$).

The total perimeter of the single passage in the plate and the eight discharge openings in the nozzle tip of the nozzle of tests A, C and D was significantly less than the total perimeter of the five passages and the eight discharge openings in the nozzle of tests B and E; namely, 130 mm (5.1 in) as compared to 179 mm (7.0 in).

By keeping the total cross-sectional area of the passage(s) and discharge openings constant for both tests, the velocity of the atomizing fluid was approximately the same through the two plates at the same flow rate of the pressurized air, and the affect of varying the total perimeter of the passages was demonstrated.

The velocity of the pressurized air was higher through the nozzle tip discharge openings than through the plates due to the relatively smaller total cross-sectional area of the discharge openings.

The results of tests A–E are set forth below in TABLE I. TABLE I presents the Sauter mean diameter of the atomized water particles, and the percentage of atomized water particles having a diameter greater than 150 microns. The Sauter mean diameter is the diameter of a droplet having the same ratio of volume to surface area as the ratio of the total volume to total surface area of all of the droplets. The amount of energy consumed to spray a kilogram of water is given in the last column of TABLE I.

The test results indicate that the dual fluid spray nozzle in accordance with the invention provides advantages as compared to the known dual fluid nozzles. The increased total perimeter of the plurality of passages in the plate and discharge openings in the nozzle tip of the nozzle, enhanced the shearing and atomization of the liquid. Comparing the results of tests A and B in view of the higher velocity of the fluid through the holes in the nozzle tip, in test B the shearing effects increased by about 31%, based on the reduction in the proportion of coarse droplets sized larger than 150 microns from 17.2% to 11.8%.

TABLE I

| TEST NO. | PASSAGES IN PLATE | AIR INLET PRESSURE (PSIG) | AIR INLET PRESSURE (kPa) | WATER INLET PRESSURE (PSIG) | WATER INLET PRESSURE (kPa) | AIR FLOW RATE (SCFM) |
|---|---|---|---|---|---|---|
| A | 1 | 77 | 531 | 82 | 565 | 70 |
| B | 5 | 75 | 517 | 80 | 552 | 70 |
| C | 1 | 93 | 641 | 96 | 662 | 85 |
| D | 1 | 66 | 455 | 66 | 455 | 70 |
| E | 5 | 84 | 579 | 95 | 655 | 70 |

| TEST NO. | AIR FLOW RATE ($Nm^3/hr$) | WATER FLOW RATE (GPM) | WATER FLOW RATE (l/hr) | SPRAYED PARTICLE SAUTER MEAN DIAMETER (MICRONS) | % SPRAYED PARTICLES >150 MICRONS | ENERGY CONSUMED (W · hr/kg water) |
|---|---|---|---|---|---|---|
| A | 110 | 3.25 | 738 | 77 | 17.2 | 13 |
| B | 110 | 3.25 | 738 | 64 | 11.8 | 13 |
| C | 134 | 3.25 | 738 | 64 | 11.3 | 17 |
| D | 110 | 2.50 | 568 | 68 | 16.4 | 16 |
| E | 110 | 4.00 | 908 | 69 | 12.3 | 11 |

Comparing the results of test C for a plate having a single passage to the results of test B for a plate having five passages, the same mean droplet diameter was achieved with five passages in test B at significantly reduced air and water inlet pressures, and a corresponding reduced consumption of energy of about 25%.

Finally, the results of tests D and E show that the sprayed particles had approximately the same mean particle diameter, while the proportion of the particles larger than 150 microns and energy consumption were significantly decreased. The air flow rate was constant for tests D and E, while the water flow rate was increased by 60%, and energy consumption was reduced by 31%, in test E.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A dual fluid spray nozzle, comprising:

a body defining a first atomization chamber, and inlet means in said body for introducing an atomizing fluid and a liquid into said first atomization chamber;

initial atomization means disposed in said first atomization chamber to initially atomize liquid introduced therein via said inlet means;

a second atomization chamber downstream of said first atomization chamber, a plate having a plurality of spaced passages therethrough through which an initially atomized liquid must pass before entering into said second atomization chamber and thereby further atomized;

and a nozzle tip mounted to said body downstream of said second atomization chamber, said nozzle tip defining a plurality of discharge openings through which the further atomized liquid from said second atomization chamber is discharged.

2. The dual fluid spray nozzle of claim 1, wherein said inlet means including a first inlet in said body for introducing an atomization fluid into said first atomization chamber and a second inlet in said body for introducing the liquid into said first atomization chamber, said initial atomization means including a target bolt which extends into said first atomization chamber in alignment with said second inlet, said target bolt having a surface against which liquid introduced into said first atomization chamber impinges, and said first inlet being positioned such that atomizing fluid introduced into said first atomization chamber atomizes the liquid introduced via said second inlet.

3. The dual fluid spray nozzle of claim 2, further comprising a liner disposed within each of said first and second atomization chambers composed of a corrosion and erosion resistant material.

4. The dual fluid spray nozzle of claim 3, wherein each of said plate and said nozzle tip are composed of a corrosion and erosion resistant material.

5. The dual fluid spray nozzle in claim 1, wherein said plurality of passages are positioned in a circular arrangement and are equally spaced with respect to each other.

6. The dual fluid spray nozzle of claim 5, wherein said plate has a thickness, and each of said passages has a length greater than said thickness.

7. The dual fluid spray nozzle of claim 1, wherein said plate includes a centrally located passage and said nozzle tip includes a discharge opening substantially in alignment with said centrally located passage.

8. The dual fluid spray nozzle of claim 7, wherein said plate has a thickness, and each of said passages has a length greater than said thickness.

9. The dual fluid spray nozzle of claim 1, wherein the spray nozzle defines a longitudinal axis and said discharge openings in said nozzle tip are oriented at an angle of between about 3°–7° relative to said longitudinal axis, said discharge openings control the spray such that a substantially cone-shaped spray pattern is produced.

10. A dual fluid spray nozzle, comprising:

a body defining a first atomization chamber, a first inlet in said body through which an atomizing fluid is introduced into said first atomization chamber, and a second inlet in said body through which a liquid is introduced into said first atomization chamber;

initial atomization means disposed in said first atomization chamber to initially atomize liquid introduced therein via said second inlet;

a first plate forming a front wall of said first atomization chamber;

a second plate disposed downstream from said first plate;

said first plate and said second plate defining a second atomization chamber therebetween;

a nozzle tip mounted to said body, said nozzle tip defining a plurality of discharge openings through which the atomized liquid is discharged, said second plate and said nozzle tip defining a third atomization chamber therebetween;

said first plate defining a plurality of first passages having a first total cross-sectional area, said first passages further atomize the initially atomized liquid passing from said first atomization chamber into said second atomization chamber; and said second plate defining a plurality of second passages having a second total cross-sectional area, said second passages further atomize the liquid passing from said second atomization chamber into said third atomization chamber, and said first total cross-sectional area being greater than said second total cross-sectional area.

11. The dual fluid spray nozzle of claim 10, therein the spray nozzle defines a longitudinal axis and said discharge openings in said nozzle tip are oriented at an angle of between about 3°–7° relative to said longitudinal axis, said discharge openings control the spray such that a substantially cone-shaped spray pattern is produced.

12. The dual fluid spray nozzle of claim 10, wherein said initial atomization means comprises a target bolt which extends into said first atomization chamber in alignment with said second inlet, said target bolt having a surface against which liquid introduced into said first atomization chamber impinges, and said first inlet being positioned such that atomizing fluid introduced into said first atomization chamber atomizes the liquid introduced via said second inlet.

13. The dual fluid spray nozzle of claim 12, further comprising a liner composed of a corrosion and erosion resistant material.

14. The dual fluid spray nozzle of claim 13, wherein said first plate, said second plate and said nozzle tip are composed of a corrosion and erosion resistant material.

15. The dual fluid spray nozzle of claim 10, wherein said first passages are positioned in a circular arrangement about said first and said second passages are positioned in a circular arrangement about said second plate.

16. The dual fluid spray nozzle of claim 15, comprising an equal number of said first passages and said second passages, and said second passages having a smaller diameter than said first passages.

17. The dual fluid spray nozzle of claim 16, wherein said first passages and said second passages are substantially in alignment with each other.

18. The dual fluid spray nozzle of claim 17, further comprising means for aligning said first and second passages with each other.

19. The dual fluid spray nozzle of claim 17, wherein said first plate has a first thickness, said second plate has a second thickness, said first passages have a length greater than said first thickness and said second passages have a length greater than said second thickness.

20. The dual fluid spray nozzle of claim 10, wherein said first plate defines a centrally located first passage, said second plate defines a centrally located second passage, and said nozzle tip defines a discharge opening substantially in alignment with said centrally located first and second passages.

21. The dual fluid spray nozzle of claim 20, comprising an equal number of said first and second passages, and said second passages having a smaller diameter than said first passages.

22. The dual fluid spray nozzle of claim 21, wherein said first passages and said second passages are substantially in alignment with each other.

23. The dual fluid spray nozzle of claim 22, further comprising means for aligning said first and second passages with each other.

24. The dual fluid spray nozzle of claim 10, comprising a lesser number of said second passages than said first passages, and said first and second passages all having the same diameter.

25. The dual fluid spray nozzle of claim 12, wherein said first plate has a first thickness, said second plate has a second thickness, said first passages have a length greater than said first thickness and said second passages have a length greater than said second thickness.

26. The method of producing an atomized spray of a slurry material, comprising the steps of:

introducing a liquid containing particles into a first atomization chamber of a dual fluid spray nozzle;

directing the liquid against an initial atomizing means disposed in said first atomization chamber to initially atomize the liquid;

passing the initially atomized liquid through a plurality of passages defined in a plate separating said first atomization chamber and a second atomization chamber to further atomize the initially atomized liquid, said plate facing the initial atomization means, and said particles having a diameter less than about one-half of the diameter of said passages; and passing the liquid from the second atomization chamber through a plurality of discharge openings formed in a nozzle tip of said spray nozzle to produce an atomized spray of liquid droplets.

27. The method of claim 26, wherein said particles are lime milk particles and said atomizing fluid is compressed air.

28. The method of claim 27, wherein said passages have a minimum diameter of about 3.0 mm and said lime milk particles have a maximum diameter of about 1.5 mm.

29. The method of claim 26, wherein a substantial portion of the atomized liquid droplets in said atomized spray have a diameter of less than about 150 microns.

30. The method of claim 29, wherein said atomized liquid droplets are discharged from said nozzle tip in a generally cone-shaped pattern.

31. A method of producing an atomized spray of a slurry material, comprising the steps of:

introducing a liquid containing particles into a first atomization chamber of a dual fluid spray nozzle;

initially atomizing the liquid in said first atomization chamber;

passing the initially atomized liquid thought a plurality of first passages defined in a first plate forming a downstream wall of said first atomization chamber and into a second atomization chamber to further atomize the initially atomized liquid, said first passages having a first diameter and a first total cross-sectional area;

passing the liquid from the second atomization chamber through a plurality of second passages defined in a second plate downstream of said first plate and into a third atomization chamber to further atomize the liquid, said second passages having a second diameter and having a second total cross-sectional area less than said first total cross-sectional, and said particles having a maximum diameter of less than about one-half of said first and second diameters; and discharging the liquid from said third atomization chamber through a plurality of discharge openings formed in a nozzle tip of said spray nozzle to produce an atomized spray of liquid droplets.

* * * * *